United States Patent [19]

Quinnell

[11] Patent Number: 4,580,374

[45] Date of Patent: Apr. 8, 1986

[54] SOFFIT AND FASCIA SYSTEM

[76] Inventor: Geoffrey C. Quinnell, 5, The Gill, Pembury, Kent, United Kingdom

[21] Appl. No.: 541,330

[22] PCT Filed: Jan. 31, 1983

[86] PCT No.: PCT/GB83/00020

§ 371 Date: Sep. 26, 1983

§ 102(e) Date: Sep. 26, 1983

[87] PCT Pub. No.: WO83/02636

PCT Pub. Date: Aug. 4, 1983

[30] Foreign Application Priority Data

Jan. 29, 1982 [GB] United Kingdom ..... 8202533

[51] Int. Cl.[4] ..... F24F 13/18; E04D 13/15

[52] U.S. Cl. ..... 52/95; 52/303; 98/37

[58] Field of Search ..... 52/94, 95, 303, 302; 98/DIG. 6, 114, 37, 29

[56] References Cited

U.S. PATENT DOCUMENTS

| | | | |
|---|---|---|---|
| 2,995,079 | 8/1961 | La Fontaine | 98/37 |
| 3,239,985 | 3/1966 | Harter . | |
| 3,256,654 | 6/1966 | Pinckney | 52/95 |
| 3,344,566 | 10/1967 | Miles et al. . | |
| 3,938,429 | 2/1976 | Perry | 98/114 |

FOREIGN PATENT DOCUMENTS

| | | | |
|---|---|---|---|
| 685111 | 4/1964 | Canada | 98/DIG. 6 |
| 1450442 | 7/1966 | France . | |
| 1024295 | 3/1966 | United Kingdom . | |
| 1181115 | 2/1970 | United Kingdom . | |
| 1587461 | 4/1981 | United Kingdom . | |
| 2116309 | 9/1983 | United Kingdom | 98/DIG. 6 |

*Primary Examiner*—John E. Murtagh

*Attorney, Agent, or Firm*—Bacon & Thomas

[57] ABSTRACT

A soffit system for a roof is disclosed which has a plastic fascia sheet and a soffit board formed of asbestos material. The soffit board has a longitudinal groove which forms a snap fit with the fascia and a rear edge of the soffit board rests on an upper portion of the wall. Adjacent soffit boards are joined by a ventilator panel which has an inner region with ventilation slots which is upwardly recessed from a peripheral region provided with grooves to engage the soffit boards.

4 Claims, 8 Drawing Figures

SOFFIT AND FASCIA SYSTEM

This invention relates to a soffit and fascia system for the eaves and/or verges of a building.

It is desirable to provide protection for the supporting member, i.e. rafters of a roof where they project beyond a wall and it is also desirable to close the underside of these roof supports to prevent entry by birds and to reduce maintenance. It is therefore known to provide a fascia board across the ends of roof rafters, from which a gutter may be supported, and to provide a soffit to bridge the gap between the fascia and the adjacent wall of the building.

It is known to use a wooden fascia board with a plastics fascia sheet attached to it, e.g. by nails. In one arrangement the soffit is constituted by a plurality of interlocking plastics panels, with the panel adjacent the fascia lockingly engaged in a channel extending along the bottom edge of the fascia. For reasons of expense, it is sometimes preferred to use soffits of other rigid sheet materials such as asbestos board. In one arrangement such a board is supported by a batten framework, the edge of the board projecting into a channel extending along the fascia. This arrangement, whilst simple and inexpensive, is vulnerable to thermal deformation, the fasica bowing out so that a gap appears between the board and the fascia.

This problem is dealt with in U.K. Pat. No. 1,587,461 which proposes that a capping, specifically in the form of a metal clip, be employed to lock the soffit in the channel. A disadvantage of this system is that the introduction of securing clips increases the expense and reduces the advantage of using inexpensive material such as asbestos board.

An object of the invention is therefore to provide a simple soffit and fascia system which has the advantages of the arrangement described in U.K. Pat. No. 1,587,461 but which is less expensive to manufacture.

According to the invention there is provided a soffit and fascia system for the eaves and/or verges of a building comprising a fascia sheet of plastics material and a soffit board of a non-plastics sheet material, the fascia sheet including an integral channel arranged to receive an edge of the soffit board and there being a groove formed in a surface of the soffit board, extending adjacent the edge thereof, in which is engageable a retaining portion provided in the channel so as to retain the baord edge in the channel.

Preferably, the board and fascia sheet form a snap fit, the retaining portion engaging resiliently in the groove. In general, the nature resiliency of the plastics material of the fascia sheet will be adequate to allow for this.

The retaining portion is preferably provided by suitably shaping the channel. Thus, in a preferred arrangement the sidewalls of the channel coverage away from the main portion of the fascia, the narrowest part acting as the retaining portion. The sidewalls may subsequently diverge away from the retaining portion, thus providing a suitable guide-in portion for when the soffit is being engaged with the fascia. During such engagement, the sidewalls will be resiliently pushed apart until the retaining portion reaches the groove, when it will snap into place.

The groove will generally be milled and of simple, i.e. rectangular, cross-section, although other cross-sections might be used to provide improved engagement in the channel. The retaining portion may be suitably shaped to provide an increased area of contact with the groove, for example having a flat, vertical face to abut against a vertical face of the groove.

A groove may be provided on both sides of the soffit, there being corresponding retaining portions on both sides of the channel. In general, however, one groove will be sufficient and will reduce cost. Where only one groove is provided, the channel sidewall on the other side of the soffit may have a terminal portion angled such that, when the soffit is in place, the terminal portion engages the surface of the soffit over a significant area. This terminal portion will also act as a guide-in for the soffit.

The fascia sheet may be of any suitable thermoplastics material such as P.V.C. and the soffit board of a non-plastics, inexpensive rigid sheet material. For reasons of convenience and expense, the soffit board is preferably of a cement based material such as asbestos, Asbestolux (Trade Mark) or the like. In general the groove will extend for the entire length of the soffit, although an intermittent groove, with correspondingly intermittent retaining portions could be used. Such an arrangement would, however, be more complex and thus expensive.

A further problem with roofing systems is the need to provide adequate ventilation to the roof space along the eaves and verge of the roof. Several proposals have been made for providing such ventilation. One proposal involves the use of ventilation slots in the soffit board. The production of such slots adds to expense, which for a low-cost system using cement based soffits can be an important factor. It may also be necessary to cover the slots with gauze or the like to prevent the ingress of vermin, insects, birds and the like. Another system involves discrete ventilators which are positioned at intervals along the soffit. This requires the forming of apertures in the soffits and the overall expense is again unsatisfactory in the context of a low cost system.

There is thus a need for a low cost ventilation system, and in accordance with a further aspect of this invention such a system comprises a pre-formed, ventilator panel, e.g. of moulded theremoplastics, having a plurality of ventilation apertures therein, the panel being interposed between two lengths of soffit and having means thereon to engage with the ends of such lengths.

Thus, a join is effected between soffit lengths, and at the same time ventilation can be provided. The engaging means can consist of slots into which soffit lengths can extend. Preferably, the panels are adapted to engage with soffits in a manner such as will allow for combinations to be formed with regard to the width of soffit and the amount of ventilation required. The panels should be adapted to interengage with a fascia. In preferred embodiments, therefore, a panel is rectangular in shape with each side having means which will engage with a soffit or a fascia. By having two sides longer than the others, a variety of widths and lengths of ventilation can be provided.

In use, the rear part of a ventilator can rest on brickwork, as does the soffit in many roofing systems. Since, in normal circumstances, this would block some of the ventilation area, a construction has been developed which will reduce this problem. Thus, each panel comprises a peripheral region and an inner region, in which the ventilation apertures are formed, and which is upwardly recessed with regard to the peripheral region. Thus when the panel rests on brickwork, the peripheral region will be in contact therewith but the inner region will be spaced therefrom so as to provide a ventilation path.

It will be appreciated that such a ventilation system, whilst of particular benefit in the low cost type of soffit system described earlier, can be used with a number of other systems and thus constitutes an invention in its own right.

An embodiment of the invention will now be described by way of example and with reference to the accompanying drawings in which.

Figure 1:
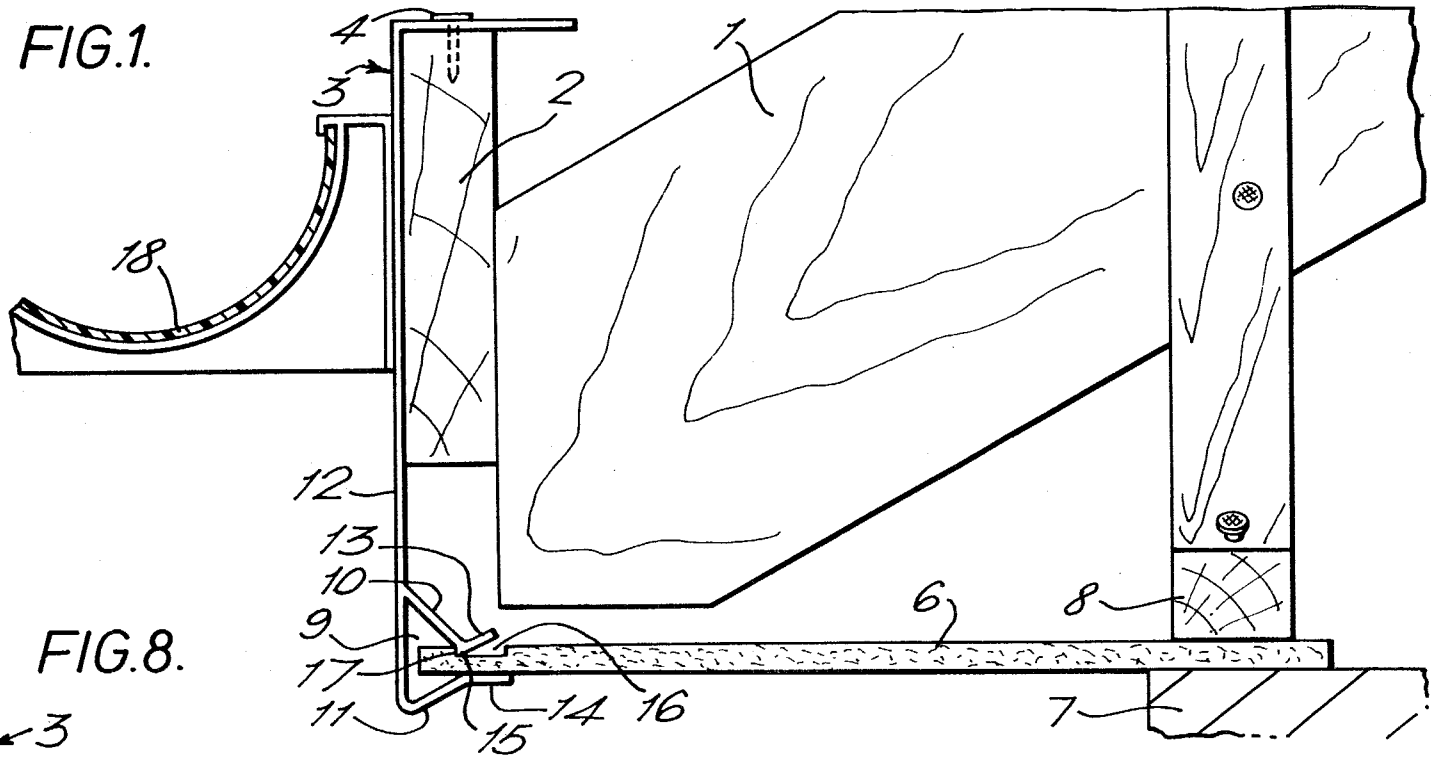
FIG. 1 is a view of a soffit and fascia system in accordance with the invention.
Figure 2:
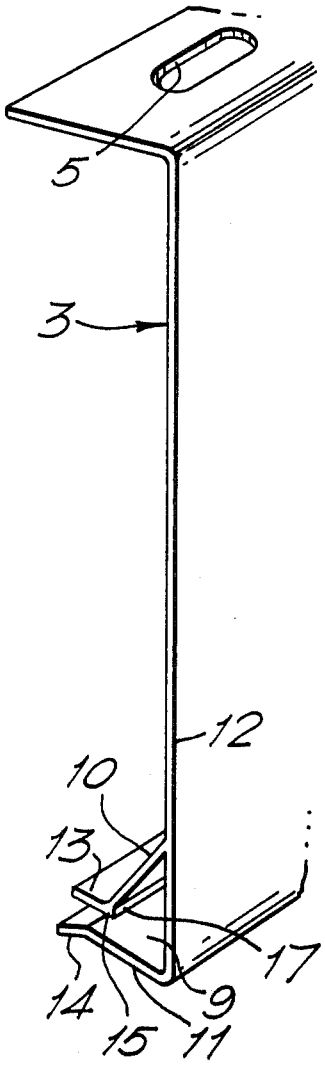
FIG. 2 is a perspective view of the fascia.

Referring now to the drawings, in FIG. 1 there is shown a roof construction including a timber roof truss 1 to which is secured a timber fascia batten 2 in a conventional manner. An extruded PVC fascia sheet 3 is secured to the batten 2 by means of nails 4 passing through apertures 5 which, as shown in FIG. 2 are elongate to allow for thermal movement.

Figure 3:
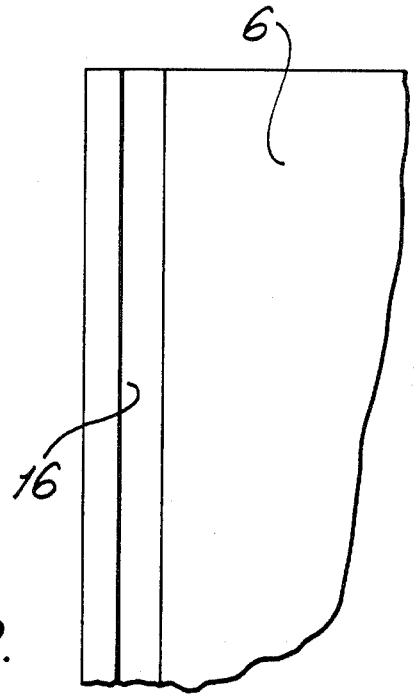
FIG. 3 is a plan view of the soffit.

A soffit sheet 6 of asbestos has one edge supported in a conventional manner between an external wall 7 and a soffit support frame 8 nailed to the roof truss. The other edge of the soffit is received in a channel 9 defined by integrally formed sidewalls 10 and 11 extending from the main portion 12 of the fascia sheet 3. The side walls converge away from the main portion of the fascia sheet, to a narrowest portion from where terminal parts 13 and 14 diverge. The ridge 15 so formed on upper side wall 10 engages in a longitudinally extending groove 16 machined in the upper surface of the soffit. The groove is of rectangular cross-section and, as can be seen from FIG. 3, extends the entire length of the soffit adjacent and parallel to its edge. The terminal part 14 of the lower side wall 11 is arranged to lie flat against the lower surface of the soffit.

Ridge 15 is provided with a flat, upwardly extending face 17 to engage the outermost, vertically extending side of groove 16 so as to assist in providing a secure engagement in the groove.

When assembling the system, divergent terminal portions 13 and 14 of the sidewalls act to guide the edge of the soffit into the channel 9. As this occurs, the sidewalls 10 and 11 move apart against their natural resilience, until ridge 15 meets groove 16 and engages therein, in the manner of a snap fit. Terminal portion 14 of sidewall 11 bears upwardly against the lower surface of the soffit to ensure that it is kept in place and any tendency for the soffit to move out of the channel is resisted by face 17 of ridge 15 abutting against the side wall of the groove. The angles of the various parts of the sidewalls are chosen such that, with the soffit secured in place, face 17 extends vertically, and portion 14 extends horizontally, so as to provide good areas of contact with their respective parts of the soffit.

As with conventional systems a gutter system 18 may be secured to the fascia by means of suitable fastening means such as screws.

There is thus provided a soffit and fascia system which is inexpensive and easy to assemble, yet secure. The provision of a groove in the asbestos sheet is an entirely new departure which eliminates the need for separate metal clips whilst involving a minimum of expense.

Figure 4:
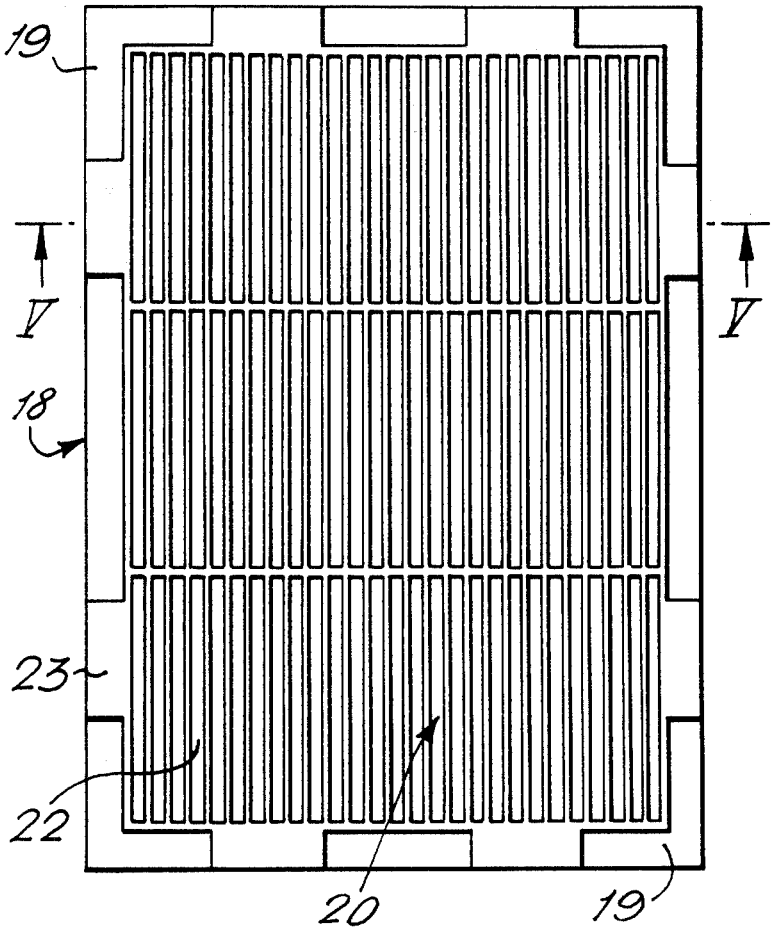
FIG. 4 is a plan view of a ventilator panel.
Figure 5:
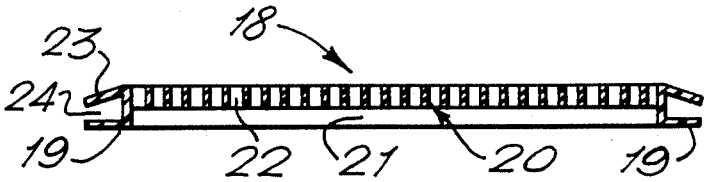
FIG. 5 is a section on line V—V of FIG. 4.

FIGS. 4 and 5 show a ventilator panel 18 of moulded polypropylene for use in the above, or other, soffit and fascia systems. The ventilator panel is rectangular with sides of 190 and 140 mm, and has a peripheral region 19 and an inner region 20. The inner region covers most of the area of the panel and is upwardly recessed from the peripheral region to leave a recess 21. The inner region is provided with a plurality of ventilator slots 22 narrow enough to prevent the ingress of vermin, birds and certain insects.

The lower peripheral region 19 of the ventilator is formed as a flange. Above this, extending outwardly from the upper edges of the inner region 20 are provided tabs 23 which define grooves 24 adapted to receive the edges of soffit boards. The tabs 23 are relatively easily frangible for a purpose to be described below.

Figure 8:
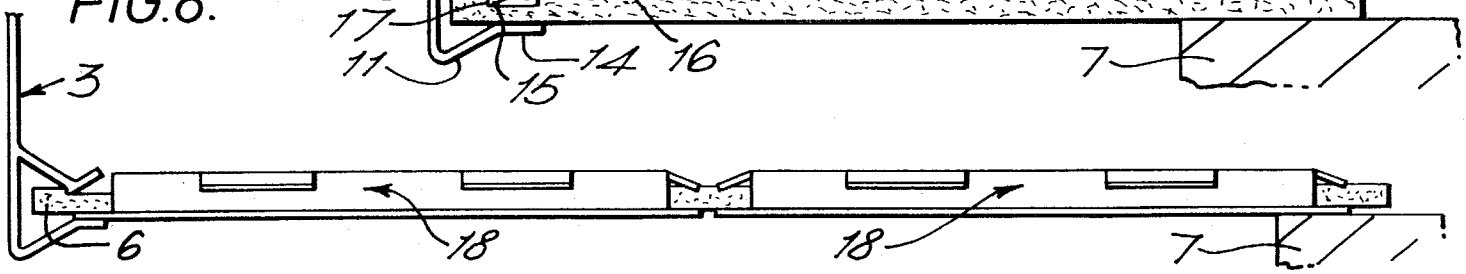
FIG. 8 shows an alternative arrangement to that of FIG. 7.
Figure 6:
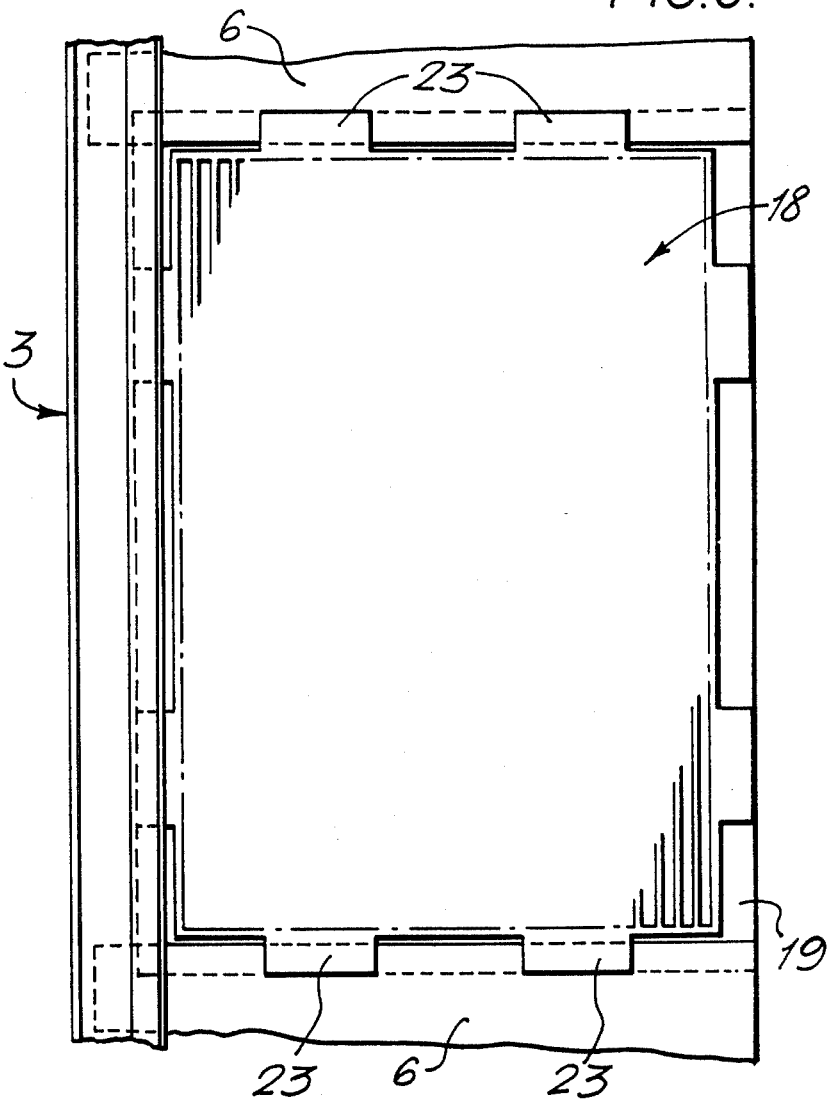
FIG. 6 shows the ventilator panel in conjunction with the soffit and fascia.
Figure 7:
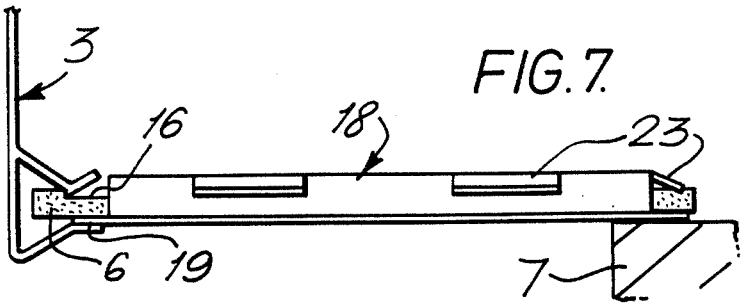
FIG. 7 shows a side view of the soffit, ventilator and fascia systems.

FIG. 6 shows the assembled system, with a ventilator panel 18, two soffit boards 6 and a fascia 3. It will be seen how the ventilator panel acts both as a ventilator and as a function. As shown in FIG. 7, the front edge of peripheral portion 19 of the ventilator is received in chanel 9 in fascia 3. To facilitate this, the front tabs 23 are broken off. Both the ventilator panel 18 and the soffit 6 have their rear edges resting on brickwork, i.e. external wall 7. The recess 21 permits air to flow in above the brickwork and through the ventilation slots in that region. FIG. 8 shows how two ventilator panels 18 can be used with a wider soffit. The "join" between the panels is effected by each engaging with the soffit. With the dimensions given above, the single panels can be used with standard soffit widths of 150 and 200 mm. By using two panels as shown in FIG. 8, widths of 300 mm and 400 mm can be accommodated. To provide the required degree of ventilation per unit length of soffit, the spacing between joints is adjusted. With current regulations, for single panel use, the spacing must be one ventilator arrangement every 1.2 m. For double panel use, of course, the spacing will be 2.4 m.

The overall system provides a low cost soffit, fascia and ventilator arrangement using inexpensive components, and a minimum of material, which easily adapts to existing roofing practice and which requires the minimum of labour when installation is effected.

I claim:

1. A soffit system for a roof comprising: a fascia with an integral channel; a number of soffit sheets or boards whose edges extend into the channel; a plurality of ventilator panels joining together the sheets or boards, each ventilator panel comprising a peripheral region having means defining slots on two opposite sides of the ventilator panel, which means receive the ends of said sheets or boards, and further comprising an inner region upwardly recessed with respect to the peripheral region, the inner region having means defining a plurality of ventilation apertures therethrough, wherein a rear part of each ventilator panel rests on top of an external wall with the peripheral region in contact therewith, but the inner region upwardly spaced therefrom so as to provide a ventilation path.

2. A system according to claim 1, wherein each ventilator panel has an edge which also extends into the channel of the fascia.

3. A system as claimed in claim 2, wherein the fascia is formed of plastic material and the soffit sheets or boards are formed of non plastic material, and wherein the fascia channel has a resilient retaining portion which engages a groove extending along the edge of the sheets or boards and formed integrally in the surface thereof.

4. A system according to claim 3, wherein the soffit sheets or boards are formed of a cement based material.

* * * * *